US007936276B2

(12) United States Patent
Springs et al.

(10) Patent No.: US 7,936,276 B2
(45) Date of Patent: May 3, 2011

(54) METHOD AND APPARATUS TO FACILITATE LIGHT SOURCE FLASHING

(75) Inventors: Keith Alan Springs, Bowling Green, KY (US); Emmet Joseph Roche, Bowling Green, KY (US)

(73) Assignee: HeathCo LLC, Bowling Green, KY (US)

( * ) Notice: Subject to any disclaimer, the term of this patent is extended or adjusted under 35 U.S.C. 154(b) by 417 days.

(21) Appl. No.: 12/059,324

(22) Filed: Mar. 31, 2008

(65) Prior Publication Data

US 2009/0243860 A1 Oct. 1, 2009

(51) Int. Cl.
*G08B 13/00* (2006.01)
*G08B 23/00* (2006.01)

(52) U.S. Cl. ..... 340/573.1; 340/541; 340/565

(58) Field of Classification Search ..... 340/573.1, 340/541, 565
See application file for complete search history.

(56) References Cited

U.S. PATENT DOCUMENTS

| | | | | | |
|---|---|---|---|---|---|
| 3,978,478 | A * | 8/1976 | Schmitz | 340/521 |
| 4,114,147 | A * | 9/1978 | Hile | 340/528 |
| 4,987,405 | A * | 1/1991 | Jakobowski | 340/479 |
| 5,371,489 | A * | 12/1994 | Carroll et al. | 340/565 |
| 5,440,290 | A * | 8/1995 | McCullough et al. | 340/552 |
| 5,781,108 | A * | 7/1998 | Jacob et al. | 340/552 |
| 5,878,283 | A * | 3/1999 | House et al. | 396/6 |
| 5,986,357 | A * | 11/1999 | Myron et al. | 307/116 |
| 7,339,471 | B1 * | 3/2008 | Chan et al. | 340/541 |
| 2005/0212443 | A1 * | 9/2005 | Yukawa et al. | 315/129 |
| 2005/0237189 | A1 * | 10/2005 | Tani | 340/541 |

* cited by examiner

*Primary Examiner* — Benjamin C Lee
*Assistant Examiner* — Andrew Bee
(74) *Attorney, Agent, or Firm* — Fitch Even Tabin & Flannery

(57) ABSTRACT

An apparatus (500) can be comprised of a light source interface (503), an animate object detector (502), and a controller circuit (501) that couples to the light source interface and the animate object detector. This controller circuit is configured and arranged to, upon detecting (101) an animate object via the animate object detector, cause (103) energy as is provided via the light source interface to be only temporarily temporally intermittent in order to cause a light source that is energized by the light source interface to flash and thereby draw attention to the animate object.

17 Claims, 2 Drawing Sheets

METHOD AND APPARATUS TO FACILITATE LIGHT SOURCE FLASHING

TECHNICAL FIELD

This invention relates generally to light sources that are responsive to animate object detectors.

BACKGROUND

Electrically-powered lighting finds myriad applications. This can include, but is not limited to, serving a security function, serving a convenience function, serving a decorative function, and so forth. In some application settings an end user may intend a given light to serve more than one such purpose. For example, a given light may serve both to provide convenience (by, for example, lighting the way for an authorized person) and to serve a security purpose (by, for example, attracting attention that may be unwanted by an unauthorized person and that may prompt such an individual to leave).

Some light sources work in conjunction with, and are responsive to, an animate object detector. In a typical scenario employing such components, the light source is energized when the animate object detector senses a local presence of an animate object (such as a person (authorized or unauthorized), a vehicle, a feral animal, or the like. This can serve to provide light that will, in turn, hopefully attract attention which may then prompt the animate object to leave the area.

Though often a successful security strategy, such an approach does not necessarily meet the needs of all potential application settings. For example, in some cases, there may be a variety of other lights which are switched on and off for a variety of reasons during the evening hours. In such a case, it may go unnoticed when yet another light simply becomes illuminated in response to detecting the presence of a possibly unauthorized person.

BRIEF DESCRIPTION OF THE DRAWINGS

The above needs are at least partially met through provision of the method and apparatus to facilitate light source flashing described in the following detailed description, particularly when studied in conjunction with the drawings, wherein.

Figure 1:
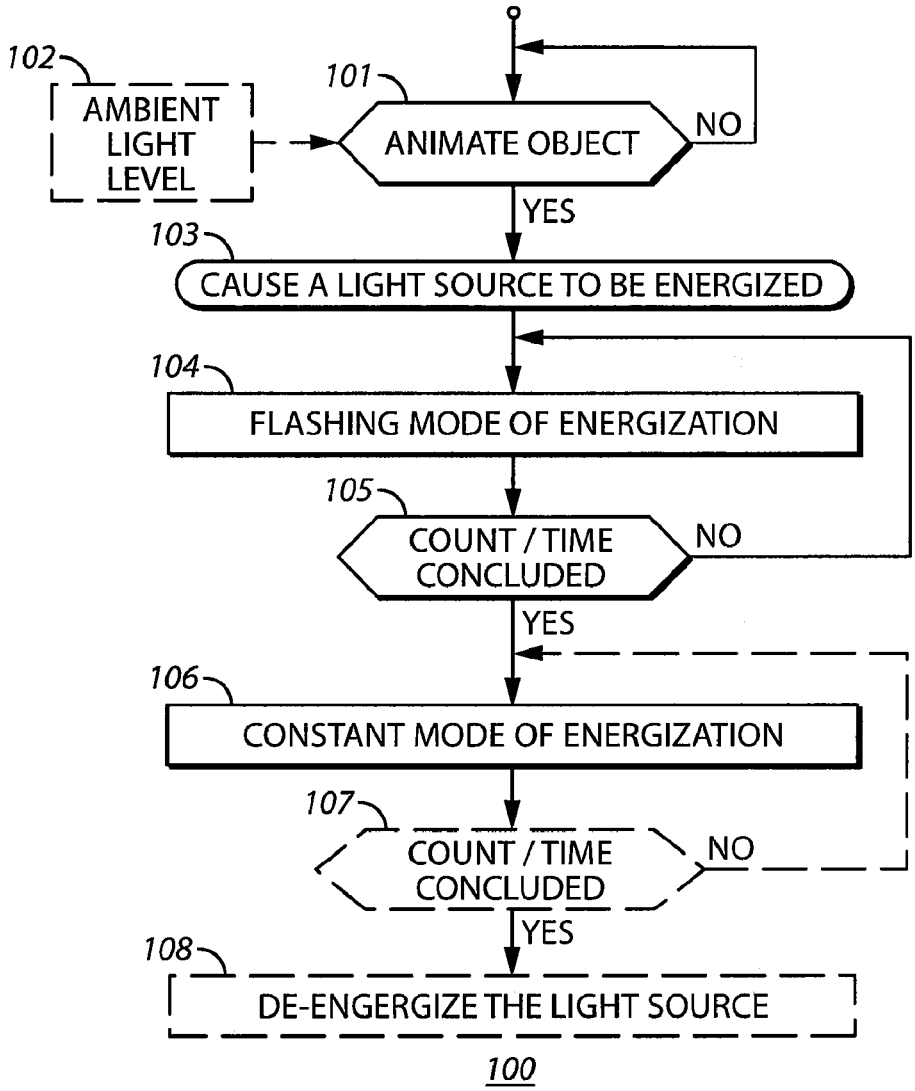
FIG. 1 comprises a flow diagram as configured in accordance with various embodiments of the invention.

Skilled artisans will appreciate that elements in the figures are illustrated for simplicity and clarity and have not necessarily been drawn to scale. For example, the dimensions and/or relative positioning of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments of the present invention. It will further be appreciated that certain actions and/or steps may be described or depicted in a particular order of occurrence while those skilled in the art will understand that such specificity with respect to sequence is not actually required. It will also be understood that the terms and expressions used herein have the ordinary technical meaning as is accorded to such terms and expressions by persons skilled in the technical field as set forth above except where different specific meanings have otherwise been set forth herein.

DETAILED DESCRIPTION

Generally speaking, pursuant to these various embodiments, an apparatus can be comprised of a light source interface, an animate object detector, and a controller circuit that couples to the light source interface and the animate object detector. This controller circuit is configured and arranged to, upon detecting an animate object via the animate object detector, cause energy as is provided via the light source interface to be only temporarily temporally intermittent in order to cause a light source that is energized by the light source interface to flash and thereby draw attention to the animate object.

These teachings will accommodate a plurality of such flashes as desired. These teachings will also accommodate configuring the control circuitry to deliver constant energization to the light source in order to cause the light source to be constantly illuminated after the aforementioned flashing. This might comprise, for example, automatically switching from the flashing mode of operation to the constant-illumination mode of operation after some predetermined period of time or following some predetermined number of flashes.

So configured, those skilled in the art will recognize and appreciate that these teachings permit existing platforms and components to be readily leveraged in favor of these results. This, in turn, provides an attention-attracting mode of operation to be automatically applied upon detecting an animate object to supplement the more ordinary response of generally illuminating such an object. Such flashing will not typically be easily confused with the ordinary operation of other lights in the vicinity and hence can serve the important purpose of being more noticeable and hence more likely to attract the attention of others in the area. Accordingly, the deterrent effect associated with security lighting is enhanced and increased.

It will also be appreciated that these teachings are readily scaled to accommodate a wide variety of components and applications settings. This can include, for example, causing multiple light sources to flash (in unison or in some synchronized or unsynchronized sequential manner) in response to detecting an animate object, using differing flash rates (where, for example, the flash rate increases as the animate object draws closer to the animate object detector), and so forth. By one approach, if desired, these teachings are readily applied in conjunction with already-installed light sources.

These and other benefits may become clearer upon making a thorough review and study of the following detailed description. Referring now to the drawings, and in particular to FIG. 1, an illustrative process that is compatible with many of these teachings will now be presented. This process 100 can be carried by, or with, a light fixture of choice. Certain illustrative examples in this regard will be provided further herein.

Pursuant to this process 100, an enabling apparatus of choice automatically detects 101 the local presence of an animate object. The nature of this detection can vary with respect to the application setting and with respect to the enabling technology utilized for this purpose. By one approach, essentially any animate object will suffice as the basis for this detection. By another approach, only animate objects that meet some additional criteria (such as those which radiate at least some minimal level of heat) will be detected.

This reference to "local" will be understood to refer to an operating range that will vary from one application setting to another but which will typically relate to the illuminating power of the light source itself. Given that the security purpose being served is to illuminate, and hence draw attention to, the detected animate object, the "local" operating range for these purposes will typically be a distance within which the light from the light source will be able to effectively accomplish that purpose.

By one approach, this process 100 will optionally accommodate informing this step of detecting 101 an animate object with additional information regarding the local ambient light level 102. For example, when the sun is shining brightly in the middle of the day, there will typically be little security value in causing a light to become energized as the resultant illumination is unlikely to be noticed by either an unauthorized trespasser or others in the vicinity who might otherwise be expected to respond to a security concern and challenge the animate object. With this in mind, by one approach this step of detecting 101 an animate object can be also made dependent upon such detection occurring in the presence of sufficiently dark ambient conditions. (Those skilled in the art will recognize that such an additional condition can be effectively implemented elsewhere within such a process 100 to achieve similar or identical results. Accordingly, it will be understood that this description, which presents this sensitivity as occurring as this particular place in the process 100, is intended to serve only in an illustrative capacity and is not intended to suggest any limitations in this regard.)

Upon detecting 101 an animate object, this process 100 provides for providing a corresponding signal which is then automatically responded to by causing 103 a light source to be energized. As noted above, this energization includes a flashing mode of operation followed by a continuous-illumination mode of operation. A non-limiting example in this regard will be presented here. Those skilled in the art will recognize and understand that this example is intended to serve only in an illustrative capacity and is not intended to comprise an exhaustive listing of all possibilities in this regard.

In this illustrative example, this step of energizing the light source begins with a flashing mode of energization 104. With momentary reference to the timing diagram 200 shown in FIG. 2, a given "flash" can be effected by a corresponding energization/de-energization cycle 201 that includes an energization pulse 202 and the absence of an energization pulse 203. During application of the energization pulse 202 the corresponding light source will of course become illuminated. Similarly, during the absence of the energization pulse 203 the light source will darken. The combination of these two behaviors produces the desired momentary presence of light which comprises the desired flash.

This can comprise, at a minimum, causing the light source to flash at least once by the application of only a single such energization/de-energization cycle 201. In many cases it will be useful to cause the light source to flash a plurality of times as denoted by reference numeral 204.

Figure 2:
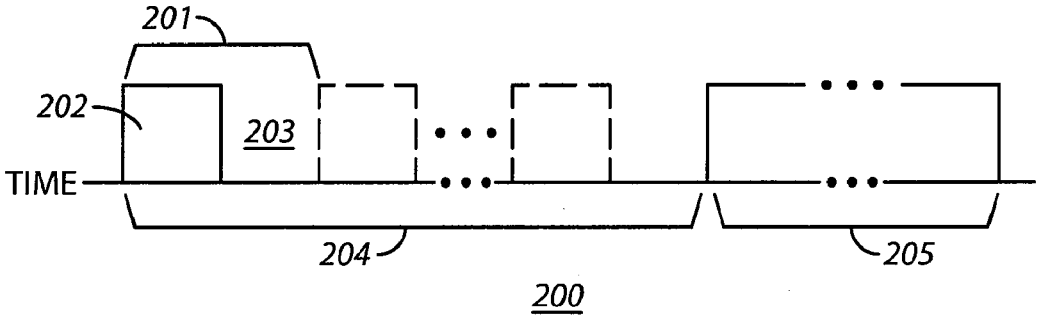
FIG. 2 comprises a timing diagram as configured in accordance with various embodiments of the invention.

The rate of flashing can vary with the needs and/or opportunities as tend to characterize a given application setting. Some light sources, for example, are capable of very rapid visibly discernable changes in illumination states and will therefore tolerate very rapid flashing rates while other light source technologies are less forgiving or useful in this regard. As examples in this regard, and presuming a 50% duty cycle of energization/de-energization as depicted in FIG. 2, flash rates of 0.5 per second, once per second, twice per second, and so forth can be useful in given application settings.

Figure 3:
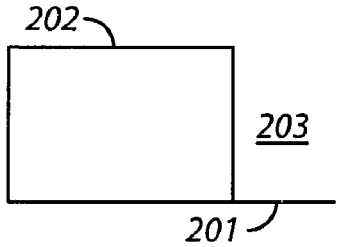
FIG. 3 comprises a timing diagram as configured in accordance with various embodiments of the invention.
Figure 4:
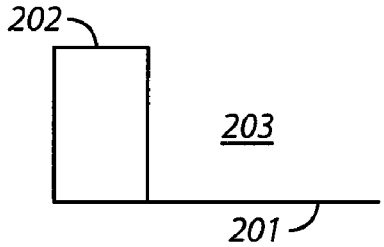
FIG. 4 comprises a timing diagram as configured in accordance with various embodiments of the invention.

If desired, the duty cycle can be varied to suit, for example, the operational behavior of a given light source or some desired flash effect. For example, and referring momentarily to FIG. 3, the energization portion 202 of the cycle 201 can be increased in duration relative to the de-energization portion 203 in order to cause the light source to be illuminated a relatively increased portion of the cycle 201. As another example, and referring now momentarily to FIG. 4, the opposite approach can be taken. In this case, the energization portion 202 of the cycle 201 is shortened relative to the de-energization portion 203.

Referring again to FIG. 1, the duration of this flashing mode of operation can comprise a function of time and/or the number of flash cycles that are accommodated. Using this approach, this process 100 will accommodate determining 105 when a given count (such as a count as provided by a system clock, a count of flash cycles, and so forth) and/or a given duration of time (such as 2 seconds, 5 seconds, or any other useful time of choice) has concluded. When true, this process 100 can then provide for concluding the flashing mode of operation and effecting a constant mode of operation 106. Referring again momentarily to FIG. 2, this constant mode of operation can comprise a period 205 of substantially constant energization. Generally speaking, for many purposes this may comprise constant energization for the light source. There may be reasons in some application settings, however, where some brief interruption (that does not perceptibly alter the appearance of constant illumination) can be tolerated and hence this acceptance of "substantially constant energization."

So configured, this process 100 serves to cause a light source to first flash and thereby draw attention to the animate object and to then remain constantly illuminated for at least some period of time to further assist in serving as a security component (for example, by continuing to illuminate the animate object when the latter has not vacated the premises).

By one approach, this constant mode of energization can persist until some follow-on event occurs. This might comprise, for example, an absence of detecting the presence of an animate object. This might also comprise, as another example, maintaining this mode of operation until reset by an authorized person. As yet another example, and referring again to FIG. 1, this process 100 will accommodate continuing with the constant mode of energization until a given count or period of time concludes 107. When this occurs, this process 100 can then provide for automatically de-energizing 108 the light source.

Figure 5:
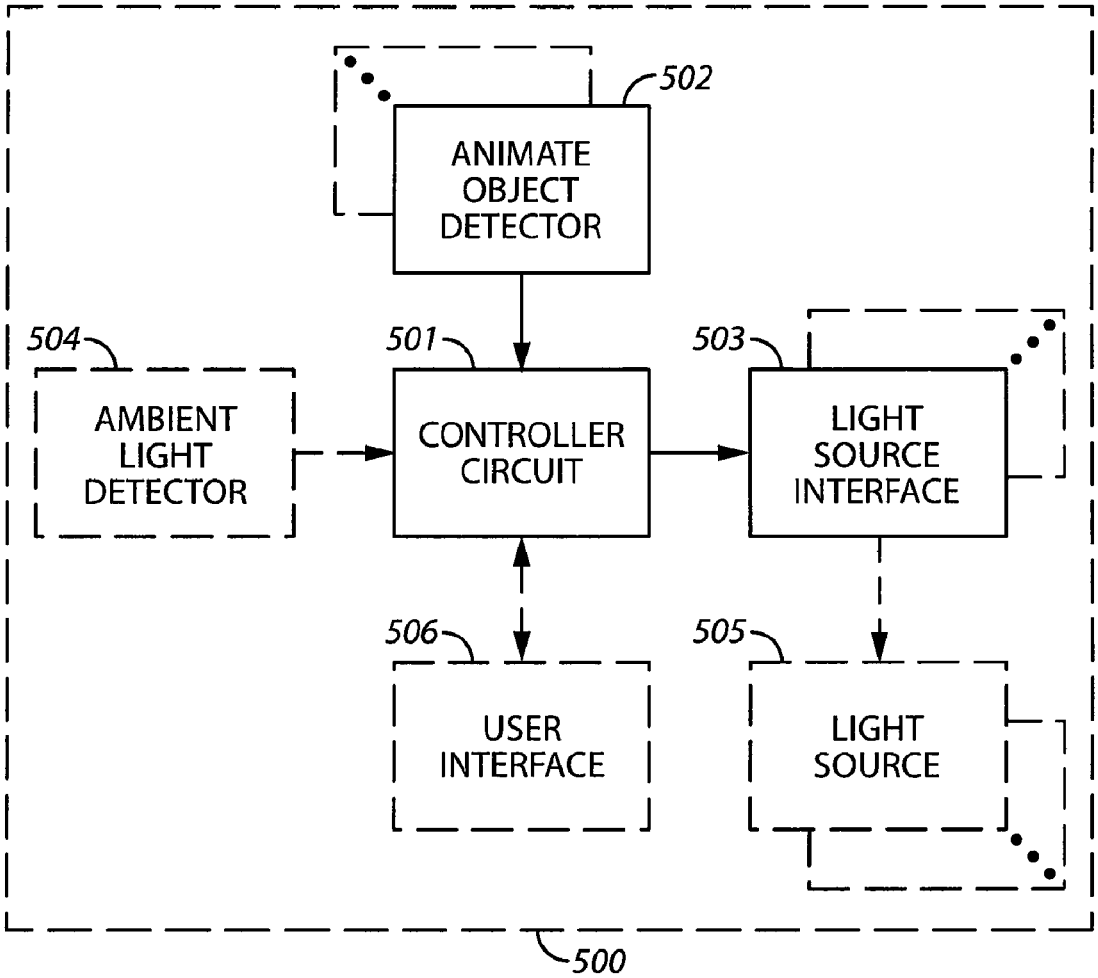
FIG. 5 comprises a block diagram as configured in accordance with various embodiments of the invention.

Those skilled in the art will appreciate that the above-described processes are readily enabled using any of a wide variety of available and/or readily configured platforms, including partially or wholly programmable platforms as are known in the art or dedicated purpose platforms as may be desired for some applications. Referring now to FIG. 5, an illustrative approach to such a platform will now be provided.

By one approach, this apparatus 500 can comprise a light fixture. This light fixture might comprise a decorate coach-style light fixture or can comprise a more utilitarian security-purposed form factor. Numerous other examples in this regard exist and will readily occur to those skilled in the art. By another approach, this apparatus 500 may instead comprise an apparatus that is not the light fixture itself but that is configured and arranged to be operably coupled to such a light fixture which includes the light source to be controlled as described. Such approaches are known in the art and further elaboration in these regards is not provided here for the sake of brevity.

This apparatus 500 can comprise a controller circuit 501 that operably couples to one or more animate object detectors 504 and one or more light source interfaces 503. Those skilled in the art will recognize and appreciate that such a controller circuit can comprise a fixed-purpose hard-wired platform or can comprise a partially or wholly programmable platform such as a microprocessor or a microcontroller. All of these architectural options are well known and understood in the art and require no further description here.

Numerous options exist with respect to the animate object detector(s) 502. This animate object detector 502 might comprise, for example, a passive infrared (PIR)-based detector as is known in the art. Other examples include, but are not limited to, an image-based detector (which operates, for example, using digital photographic images that are processed to detect, via pattern comparisons, the presence of an animate object), a sound-based detector (which operates, for example, using ultrasonic reflections to detect the presence of an animate object), an active light-based detector (such as a laser-based detection system as are known in the art), and so forth.

Numerous options also exist with respect to the light source interface(s) 503. These can comprise, for example, an interface to compatibly couple to a light source (or sources) 505. This interface can comprise, for example, a socket or sockets to receive a bulb type of choice (such as an incandescent bulb, a fluorescent bulb, and so forth) and/or the electrical conductors that couple to a permanently installed light source (such as one or more light emitting diodes (LEDs)). Typically, the particular light sources selected will reflect the particular needs and requirements as well as the opportunities that tend to characterize a given application setting. Much is known in these regards and requires no repeating here.

This apparatus 500 can also optionally comprise an ambient light detector 504 to provide information as described above regarding ambient light conditions to the controller circuit 501. The controller circuit 501 can then employ such information, when available, as described above to further inform the implementation of these teachings.

These teachings will also accommodate, if desired, providing a user interface 506 that operably couples to the controller circuitry 501. Numerous options exist in this regard. For example, the user interface 506 might serve as a user input mechanism and hence might comprise one or more buttons, one or more continuous controls, a keypad, a touchscreen, a cursor control device, a voice recognition-based input, and so forth. In this case, for example, the controller circuit 501 can be configured and arranged to immediately terminate the intermittent provision of energy to the light source 505 via the light source interface 503 in response to an end user's instructions as entered via this user interface 506.

In any event, this controller circuit 501 can be configured and arranged (via, for example, corresponding programming as will be well understood by those skilled in the art) to carry out one or more of the described steps, actions, and functionalities set forth herein. This can comprise, for example, configuring and arranging the controller circuit 501 to, upon detecting an animate object via the animate object detector 502, cause energy as is provided via the light source interface 503 to be only temporarily temporally intermittent in order to cause the light source 505 to flash and thereby draw attention to the detected animate object. Any of the flashing strategies as are described herein can be employed in this regard. The controller circuit 501 can then be further configured and arranged to automatically follow this flashing mode of operation with constant illumination of the light source 505 as is also described herein.

As used herein, therefore, this expression "only temporarily temporally intermittent" will be understand to mean that the flashing mode of operation (i.e., the "temporally intermittent" mode of operation) is only "temporary" in that it is operationally followed by a different mode of activation/energization It will therefore be understood that it is not an example of being only temporarily temporally intermittent when a light flashes intermittently as the only mode of energization and is then simply de-energized as might be the case, for example, with a strobe light-based security light.

Those skilled in the art will recognize and understand that such an apparatus 500 may be comprised of a plurality of physically distinct elements as is suggested by the illustration shown in FIG. 5. It is also possible, however, to view this illustration as comprising a logical view, in which case one or more of these elements can be enabled and realized via a shared platform. It will also be understood that such a shared platform may comprise a wholly or at least partially programmable platform as are known in the art.

So configured, those skilled in the art will recognize and appreciate that these teachings provide for a cost effective, simple, yet highly effective way to substantially increase the security benefits and deterrent effects that are associated with lighting that works in conjunction with an animate object detector. These teachings are both very flexible in practice and highly scalable to accommodate a wide range of application settings, animate object detectors, light sources, and so forth. Those skilled in the art will also appreciate that these teachings are readily employed in conjunction with numerous existing components and lighting platforms and hence permit a large existing infrastructure base to be leveraged in favor of these benefits.

Those skilled in the art will recognize that a wide variety of modifications, alterations, and combinations can be made with respect to the above described embodiments without departing from the spirit and scope of the invention, and that such modifications, alterations, and combinations are to be viewed as being within the ambit of the inventive concept. As one illustrative example in this regard, in the examples provided above the rate of flashing remained constant during the flashing mode of operation. If desired, however, the rate of flashing could be varied with respect to one or more influences of interest. For example, the rate of flashing could be caused to increase with time, such that the flashing begins at one rate and becomes gradually more rapid over, say, a five second period of operation. As another example, the rate of flashing could be increased as the signal from the animate object detector indicates an increasing proximity of the animate object. In such a case, the flashing rate will increase as the animate object draws closer to the animate object detector.

As another illustrative example in these regards, these teachings will readily accommodate preceding the aforementioned flashing mode of operation with a short period of substantially constant illumination. This might comprise, for example, first causing the light source to be constantly illuminated for, say, a fraction of a second, one second, or two seconds and then beginning with the flashing mode of operation followed by the constant mode of energization.

As yet another illustrative example in these regards, these teachings will also readily accommodate re-entering the flashing mode of operation at the conclusion of the constant mode of operation. By this approach, for example, upon detecting an animate object these teachings would provide for flashing the light source (for example, for 2 seconds), then constantly illuminating the light source (for example, for 5 seconds), followed by again flashing the light source (for example, for 3 seconds). These modes of operation can be alternated back and forth as desired. It will also be understood that the flashing mode of operation in such an application setting can vary from one instance to another. The first period of flashing might comprise a flashing frequency of once every 2 seconds while a next subsequent period of flashing, following a period of constant illumination, might employ a faster flashing frequency such as once every second.

We claim:

1. An apparatus comprising:

a light source interface configured to energize a light source for illuminating an area;

an animate object detector for detecting an animate object in the area;

a controller circuit operably coupled to the animate object detector and to the light source interface and being configured and arranged to:

upon detecting an animate object via the animate object detector, causing energy as is provided via the light source interface to be only temporarily intermittent in order to cause the light source that is energized via the light source interface upon detecting an animate object to flash for a predetermined period and thereby draw attention to the animate object; and following the predetermined period, causing the light source interface to deliver constant energization to the light source in order to cause the light source to constantly illuminate the area for as long as an animate object is detected, and thereafter de-energizing the light source.

2. The apparatus of claim 1 wherein the animate object detector comprises a passive infrared-based detector.

3. The apparatus of claim 1 wherein the controller circuit is configured and arranged to cause energy as provided via the light source interface to be only temporarily intermittent in order to cause a light source that is energized via the light source interface to flash only a single time.

4. The apparatus of claim 1 wherein the controller circuit is configured and arranged to cause energy as provided via the light source interface to be only temporarily intermittent in order to cause a light source that is energized via the light source interface to flash a plurality of times.

5. The apparatus of claim 1 wherein the controller circuit is configured and arranged to cause energy as provided via the light source interface to be only temporarily intermittent in order to cause a light source that is energized via the light source interface to flash about once per second.

6. The apparatus of claim 1 wherein the controller circuit is further configured and arranged to automatically de-energize the light source via the light source interface a predetermined amount of time following the energization of the light source a determination that an animate object is not detected.

7. The apparatus of claim 1 wherein the controller circuit is configured and arranged to cause energy as provided via the light source interface to be only temporarily intermittent only upon conclusion of an initial predetermined interval of time following detection of the animate object.

8. The apparatus of claim 1 further comprising:

a user interface operably coupled to the controller circuit;

wherein the controller circuit is further configured and arranged to terminate the intermittent provision of energy to the light source interface in response to an end user's instructions as entered via the user interface.

9. The apparatus of claim 1 wherein the apparatus comprises a light fixture.

10. The apparatus of claim 1 wherein the apparatus is configured and arranged to be operably coupled to a light fixture that includes the light source.

11. The apparatus of claim 1 wherein the animate object detector comprises at least one of:

an image-based detector;

a sound-based detector;

an active light-based detector.

12. A method comprising:

automatically detecting by an animate object detector an animate object in an area and providing a corresponding signal;

automatically responding by a controller circuit to the signal by causing a light source to be energized using:

a flashing mode of energization; and following the flashing mode of energization, a constant mode of energization; to thereby cause the light source to first flash to thereby draw attention to the animate object and to then remain constantly illuminated to illuminate the area for as long as an animate object is detected, and thereafter causing the light source to be de-energized.

13. The method of claim 12 wherein the flashing mode of energization comprises causing the light source to flash at least once.

14. The method of claim 13 wherein causing the light source to flash at least once comprises causing the light source to flash at least once about once per second.

15. The method of claim 13 wherein causing the light source to flash at least once comprises causing the light source to flash a plurality of times.

16. The method of claim 15 wherein causing the light source to flash a plurality of times comprises causing the light source to flash for a predetermined period of time.

17. The method of claim 12 wherein automatically responding to the signal further comprises automatically de-energizing the light source following a determination that an animate object is not detected.

* * * * *

UNITED STATES PATENT AND TRADEMARK OFFICE

CERTIFICATE OF CORRECTION

PATENT NO. : 7,936,276 B2
APPLICATION NO. : 12/059324
DATED : May 3, 2011
INVENTOR(S) : Keith Alan Springs and Emmet Joseph Roche It is certified that error appears in the above-identified patent and that said Letters Patent is hereby corrected as shown below:

Column 7, Claim 1, Line 21; After "as" delete "is"; and

Column 7, Claim 6, Line 53; After "following" delete "the energization of the light source".

Signed and Sealed this
Twenty-sixth Day of July, 2011

David J. Kappos

David J. Kappos
*Director of the United States Patent and Trademark Office*